United States Patent [19]

Heusinkveld

[11] Patent Number: 4,865,323

[45] Date of Patent: Sep. 12, 1989

[54] SPHERICAL PUZZLE

[76] Inventor: Paul A. Heusinkveld, 3800 N. Fairfax Dr., Apt. 308, Arlington, Va. 22203

[21] Appl. No.: 180,834

[22] Filed: Apr. 12, 1988

[51] Int. Cl.[4] ..... A63F 9/08

[52] U.S. Cl. ..... 273/153 S

[58] Field of Search ..... 273/153 S

[56] References Cited

U.S. PATENT DOCUMENTS 4,441,715 4/1984 Titus ..... 273/153 S

FOREIGN PATENT DOCUMENTS 8106197.8 9/1981 Fed. Rep. of Germany ... 273/153 S
3206561 10/1983 Fed. Rep. of Germany ... 273/153 S
1227223 4/1986 U.S.S.R. ..... 273/153 S

*Primary Examiner*—Anton O. Oechsle
*Attorney, Agent, or Firm*—Richard C. Litman

[57] ABSTRACT

A three dimensional sliding element puzzle having a surface that is spherical in shape. The sphere is divided into longitudinal segments and latitudinal bands of surface elements. The puzzle is solved by rearranging the surface elements. The surface elements are rearranged by latitudinally rotating latitudinal bands of elements, and are rearranged by rotating hemispherical sets of longitudinal segments. The surface elements may have a pattern, color or numeric coding to indicate when they are arranged in a solution set. The surface elements may also be imprinted so that the solution is a map of the earth or another globe. The surface elements may also be designed to have a number of configurations forming a number of possible solutions.

10 Claims, 6 Drawing Sheets

FIG. 6A
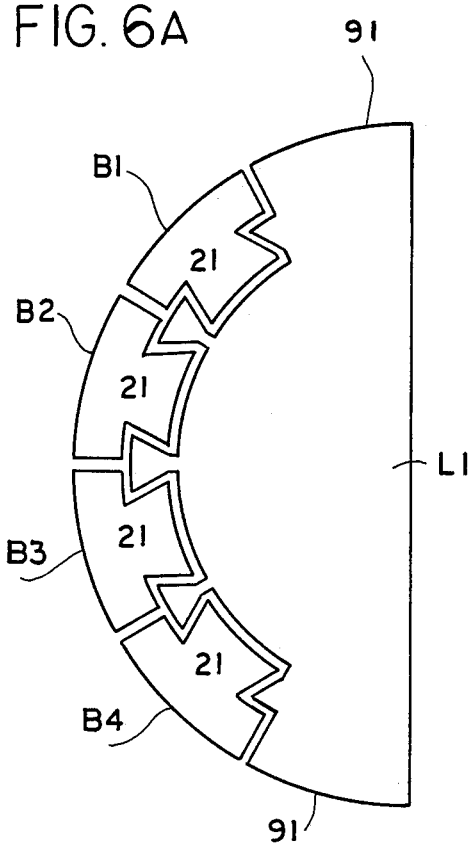
FIG. 6B
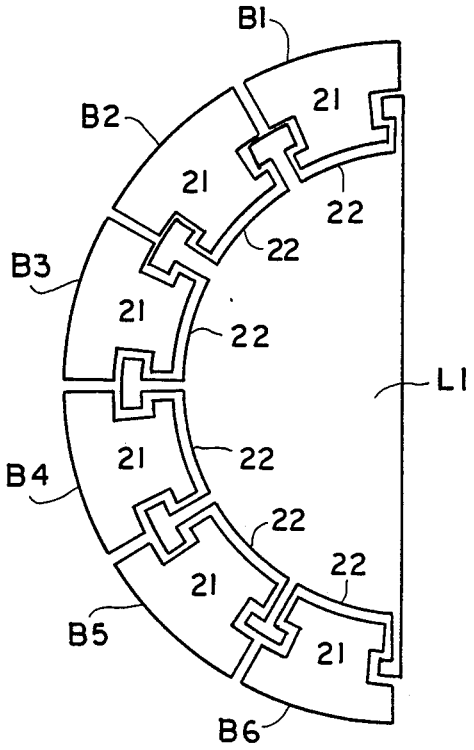
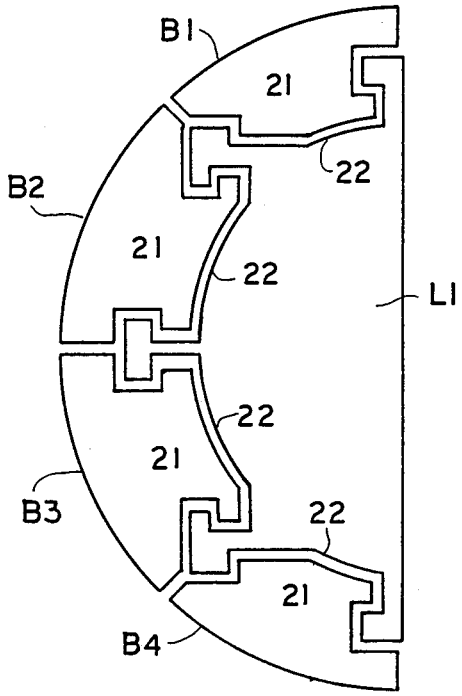
FIG. 6C
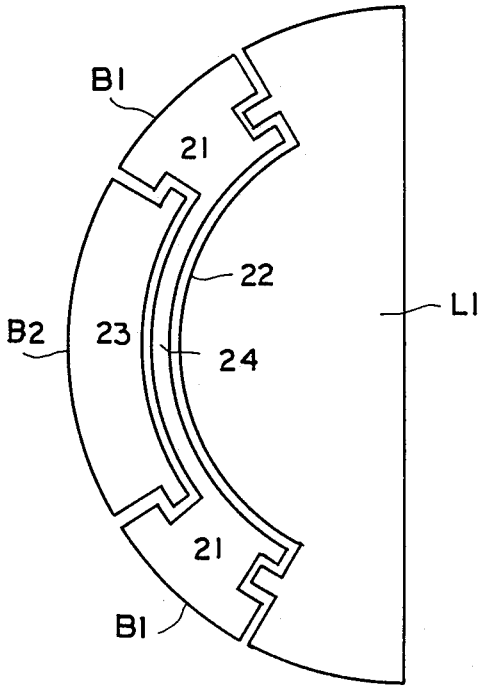
FIG. 6D

FIG. 7A
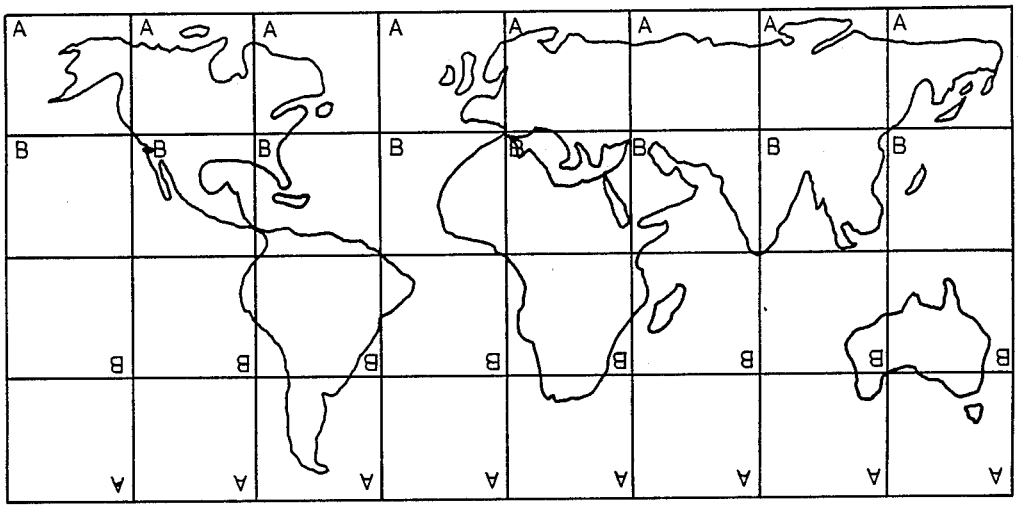
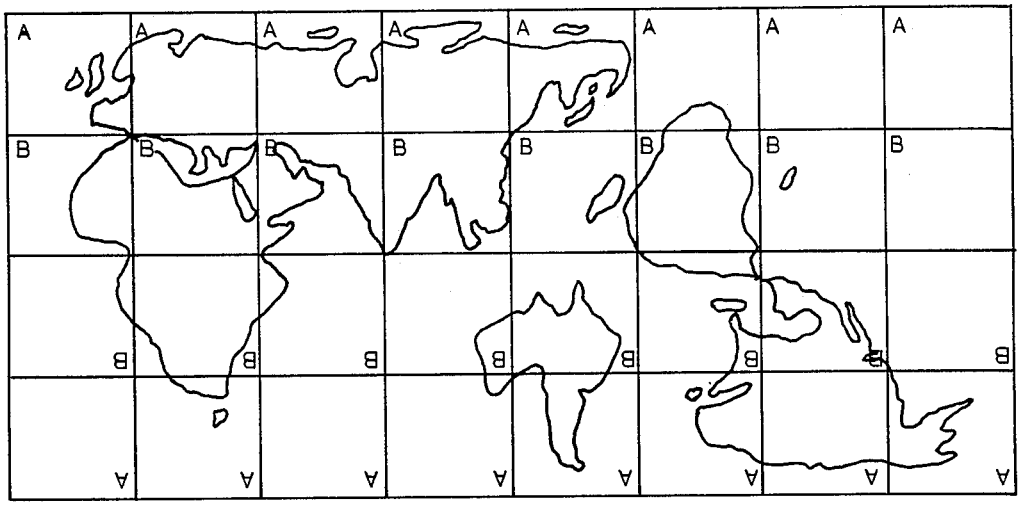
FIG. 7B

SPHERICAL PUZZLE

BACKGROUND OF THE INVENTION

1. Field of the Invention

The invention relates to a puzzle, and more particularly, the invention is directed to an improved three dimensional puzzle that is solved by manipulating a plurality of interconnected pieces without disassembly to form a desired pattern.

The invention further relates to a three dimensional sliding element puzzle with an exterior in the shape of a sphere, wherein the sphere is divided into a plurality of segments by a plurality of longitudinal planes passing through the top and bottom axis of the sphere, and divided into a plurality of lattitudinal bands by a plurality of planes perpendicular to the longitudinal axis of teh sphere.

More particularly, the invention is directed to providing a means for rotating any two hemispherical sets of segments relative to one another. The invention also relates to providing surface elements which may be rotated latitudinally about the sphere. The construction of the invention uses a limited number of types of parts, thereby making manufacture simple and inexpensive. Further, the construction is easilty generalizable to spherical puzzles having any even number of longitudinal segments and any number of latitudinal bands of surface elements.

The invention may be used for a variety of applications where it is desired to scramble or unscramble a pattern on a spherical or globe surface. In particular, the invention provides for a large number of possible solution configurations in a compact and easily manipulated puzzle.

2. Description of the Prior Art

Various prior art puzzle devices and the like, are well known and are found to be exemplary of the U.S. Prior Art. They are:

| | |
|---|---|
| 3,081,089 | Gustafson |
| 4,377,286 | Constantinescu |
| 4,378,117 | Rubik |
| 4,441,715 | Titus |
| 4,522,401 | Gustafson |
| 4,540,177 | Horvath |
| 4,557,484 | Sherman, Jr. et al. |

These patents in general disclose puzzles where a plurality of connected pieces are unscrambled by displacing some pieces relative to one another, usually about a common point or plane.

The patents to Gustafson, Constantinescu, Rubik and Horvarth disclose puzzles where a central core has pivoting members or surface pieces attached thereto.

The patent to Titus discloses a spherical puzzle where a plurality of sections are interlocked so that they may be hemispherically rotated.

The patent to Horvath discloses a spherical puzzle where hemispheres are rotated to modify a curved track that holds a plurality of beads.

These patents or known prior uses teach and disclose various types of puzzles of various sorts and manufactures, and the like, as well as method of their construction; but none of them, whether taken singly or in combination, disclose the specific details of the combination of the invention in such a way as to bear upon the claims of the present invention.

The present invention is an improvement upon these prior art devices in that it provides a construction of a puzzle where any longitudinal segment may be positioned adjacent to any other longitudinal segment. Further, the invention includes means for mounting a plurality of surface elements so that a smooth spherical outer surface is formed that is free of large gaps between the elements, and is also free of protruding polar caps.

SUMMARY OF THE INVENTION

An object, feature and advantage of the invention is to provide a novel three dimensional sliding element puzzle that is challenging, entertaining, and pleasing in appearance.

Another object of the invention is to provide a puzzle which is self-contained and easy to operate.

Another object, advantage and feature of the invention is to provide a novel and improved construction of a three dimensional sliding element puzzle, to wit, the employment of hemispherically rotatable segments and latitudinally displaceable surface elements in combination. This is a substantial improvement over existing practices because it allows a great number of solutions.

Yet another object of the invention is to provide a puzzle having a hollow center.

A further object of the invention is to provide a spherical sliding element puzzle having indicia thereon, which can have either one or multiple solution configurations; thereby allowing the puzzle to be used for a variety of purposes such as education, entertainment, or encryption of information.

Yet another object of the invention is to provide a spherical sliding element puzzle, wherein the surface elements cover the entire sphere, leaving no protruding polar caps or unsightly gaps between segments.

These, together with other objects and advantages of the invention reside in the details of the process and the operation thereof, as is more fully hereinafter described and claimed. References are made to drawings forming a part hereof, wherein like numerals refer to like elements throughout.

DESCRIPTION OF THE SEVERAL VIEWS OF THE DRAWINGS

FIG. 3 also illustrates an alternative embodiment of the invention having a hollow center.

FIGS. 6A, 6B, and 6C each shown a side sectional view of alternative constructions for providing means for slidably attaching the surface shell elements to the latitudinal slices.

FIG. 6D shows an alternative embodiment of the invention, wherein secondary surface shell elements are slidably mounted onto a band of primary surface shell elements.

FIG. 7A is a plan view of a two dimensional mercator map which could be used as indicia for the surface shell elements of the puzzle configuration shown in FIG. 1, for which one solution set depicts a map of the earth.

FIG. 7B shows another arrangement of the elements in FIG. 7A for which another logical solution set appears to be a map, however, not a map of the earth.

DETAILED DESCRIPTION OF THE PREFERRED EMBODIMENT

Figure 1:
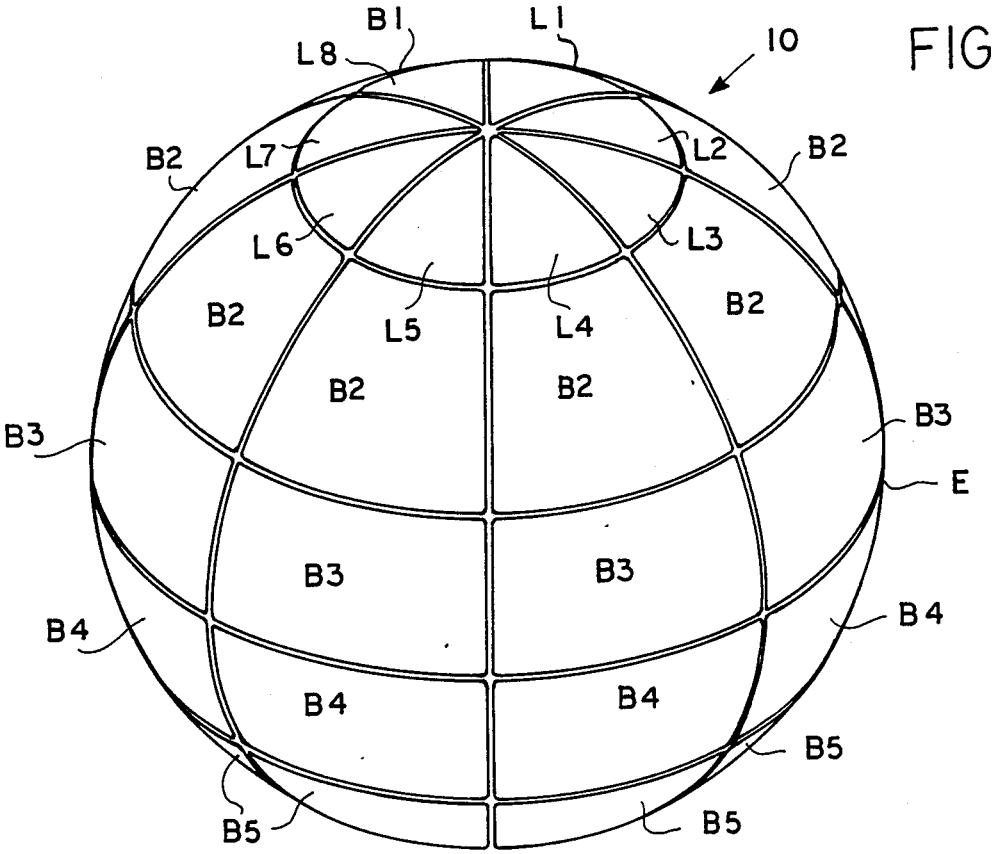
FIG. 1 is a perspective view of one embodiment of the invention, featuring eight longitudinal segments and six latitudinal bands.

As shown is FIG. 1, the invention appears as a puzzle 10 in the shape of a sphere. The sphere is divided into an even number of equal longitudinal segments, L1 to L8 formed by any number of planes passing through the sphere in such a manner that they include a line connecting the two poles and divide the sphere into equal segments. The longitudinal segments L1 to L8 are rotatably attached by an equal number of elongated arcuate segment joining elements (not shown in this view). The segment joining elements fit into channels on the planar sides of the segments, thereby attaching the segments together and at the same time allowing the segments to rotate with respect to one another along any longitudinal division by rotating any two hemispheres. In FIG. 1 the invention is shown comprising eight longitudinal segments L1 to L8. However, the construction of the invention is generalizable to any even number of equal longitudinal segments. Also shown in FIG. 1 are the plurality of surface shell elements arranged in bands B1 to B6 that make up the spherical surface of the puzzle (B6 is hidden in this view). The bands of surface shell elements B1 to B6 are are latitudinally rotatable about the puzzle. The configuration shown has eight longitudinal segments L1 to L8 and six latitudinal bands B1 to B6, thereby having a total of 48 surface shell elements. The puzzle is symmetrical about its equator E, so that the surface shell elements in band B2 ar interchangeable with those in band B5 by the process of rotating a hemispherical set of longitudinal segments L1 to L8.

The surface shell elements in bands B1 to B6 may have a variety of types of suitable indicia thereon, for the purpose of allowing a solution configuration to be identified. The surface shell elements in bands B1 to B6 may have a color code, or shaded pattern, or be pictorially, numerically or alphabetically coded. For example, the indicia may be configurable in the shape of a map of the earth or another planet.

Figure 1A:
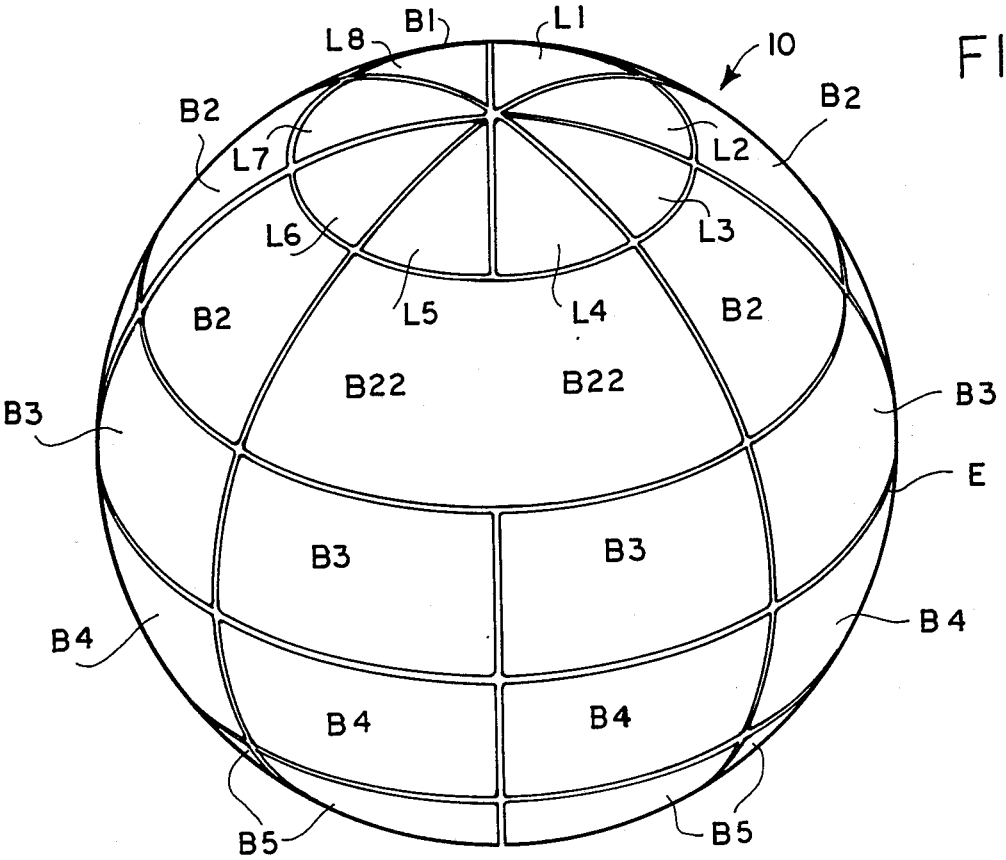
FIG. 1A is a persepective view of an alternative embodiment of the invention, showing the invention having a surface shell element which spans across the longitudinal segments.

In the embodiment of FIG. 1, each of the eight longitudinal segments L1 to L8 is identical. Also, the surface shell elements in any latitudinal band are interchangeable with the symmetrically opposite band in the opposite hemisphere. For example, the surface shell elements in bands B3 and B4 are interchangeable. As shown in FIG. 1A, a surface shell element B22 may span across two longitudinal segments. The configuration where one or more surface shell elements B22 are so constructed will reduce the number of possible solutions of the puzzle, but will also make manipulation of the puzzle more difficult.

Through a combination of longitudinal and latitudinal rotations, the surface elements of the sphere may be rearranged into a large number of possible configurations, with the possible number of configurations increasing with the number of surface shell elements. For an even number of latitudinal bands B and number of longitudinal segments L, the number of configurations N of the puzzle is:

$$N=((2*L)!)^{B/2}$$

For the embodiment shown in FIG. 1, having L=8 and B=4, there are $4.38*10^{26}$ configurations.

For an odd number of latitudinal bands B and number of longitudinal segments L the number of possible configuration of the puzzle is:

$$N=((2*L-1)!)^{(B-1)/2*}(L!)$$

For an embodiment having L=8 and B=5, this equals $6.89*10^{28}$ possible configurations.

Figure 2:
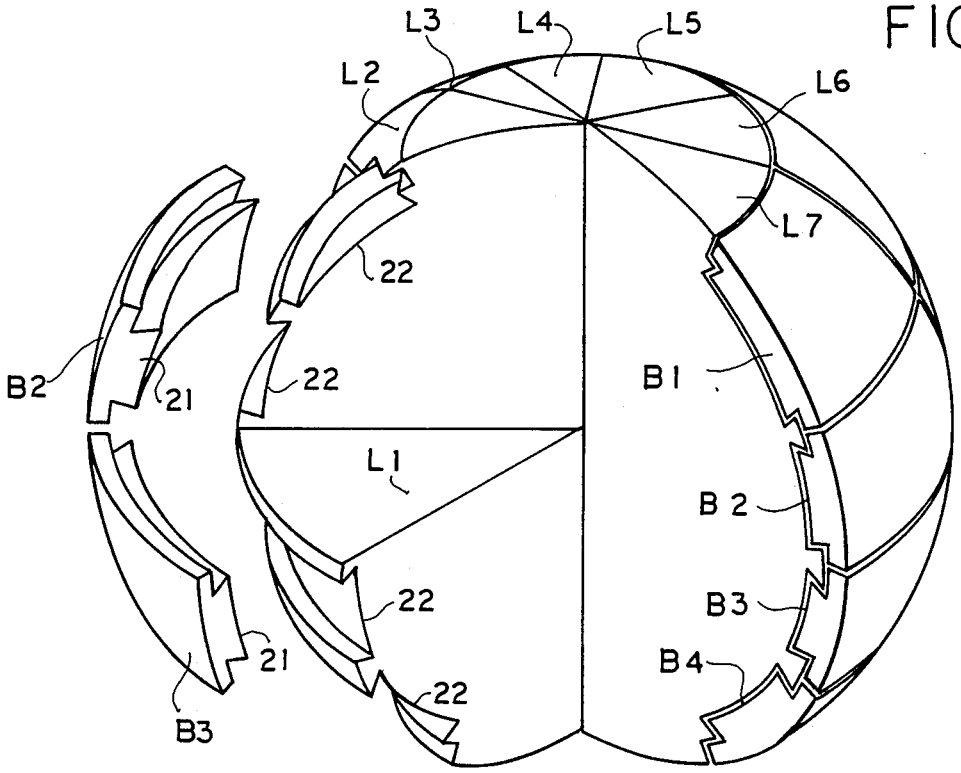
FIG. 2 is a perspective view, with cutaway sections, which illustrates one possible way in which the surface shell elements can be rotated latitudinally around the sphere.

FIG. 2 shows a preferred means for slidably attaching the bands of surface shell elements B1 to B4 to the longitudinal segments L1 to L8 (segment L8 is not shown in this view). This figure also shows an alternate embodiment of the invention wherein there are four bands of shell elements B1 to B4 and wherein the longitudinal segments L1 to L8 have smooth polar caps 91. Each shell element B1 to B4 has a latitudinal flange 21 that protrudes from the inside curved surface of the shell elements B1 to B4. The flange 21 fits into latitudinal channels 22 which are set into the longitudinal segments L1 to L8, allowing each band B1 to B4 of the surface shell elements to be rotated about the sphere.

FIGS. 6A, 6B, 6C and 6D each show alternative constructions for the latitudinal flanges 21 and latitudinal slots 22. FIG. 6A repeats the construction of FIG. 2, showing each longitudinal segment having four latitudinal slots 22, and a smooth polar cap surface 91 of each pole. The smooth polar cap surface 91 provides a contour that meets flush with the adjacent bands of surface shell elements B1 and B4. FIGS. 6B and 6C show embodiments of the invention wherein the bands of surface shell elements comprise the entire spherical surface of the puzzle. In FIG. 6B, each longitudinal segment L1 has six bands of surface shell elements B1 to B6. Bands of surface shell elements B1 and 6B cover the poles of the longitudinal segments. Each surface shell element in bands B1 to B6 has a latitudinal flange 21 slidably engaging a latitudinal channel 22, so that the bands of surface shell elements B1 to B6 may be rotated latitudinally around the surface of the sphere. FIG. 6C shows an arrangement similar to FIG. 6B having four bands of surface shell elements B1 to B4. FIG. 6D shows an embodiment of the invention where a band of secondary surface shell elements B2 is slidably mounted on to a band of primary surface shell elements B1, by means of a latitudinal flange 23 slidably engaging a latitudinal channel 24. The band of primary surface shell elements B1 are slidably attached to the longitudinal segments L1 by means of a flange 21 and channel 22, as shown.

Figure 3:
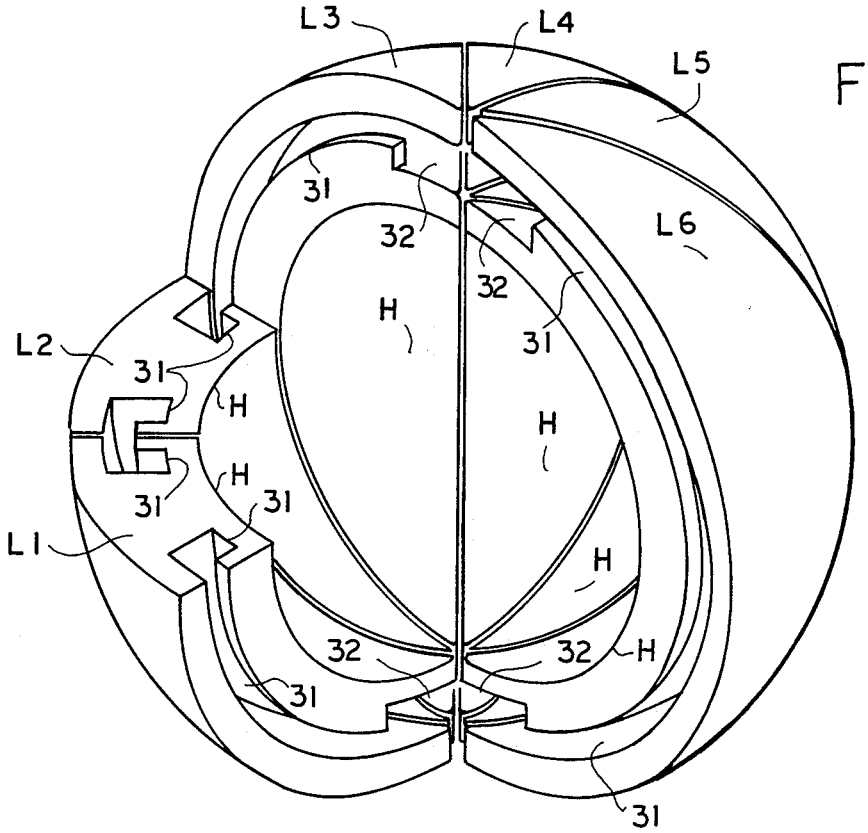
FIG. 3 is a perspective view, with cutaway section, which illustrates the puzzle configured into eight longitudinal segments.

FIG. 3 shows the construction and orientation of longitudinal segments L1 to L8 (L7 and L8 are not shown in this view). An elongated arcuate channel 31 is disposed on each planar side of each longitudinal segment L1 to L8. The elongated arcuate channel 31 has a cross segment that receives an elongated arcuate segment joining element (not shown this view). The Elongated arcuate channel 31 also has a notch 32 at each end to allow rotation of the segments L1 to L8. FIG. 3 also shows an alternative embodiment where the longitudinal sections L1 to L8 have an internal compound curved surface H, which defines a hollow interior space within the sphere.

Figure 4:
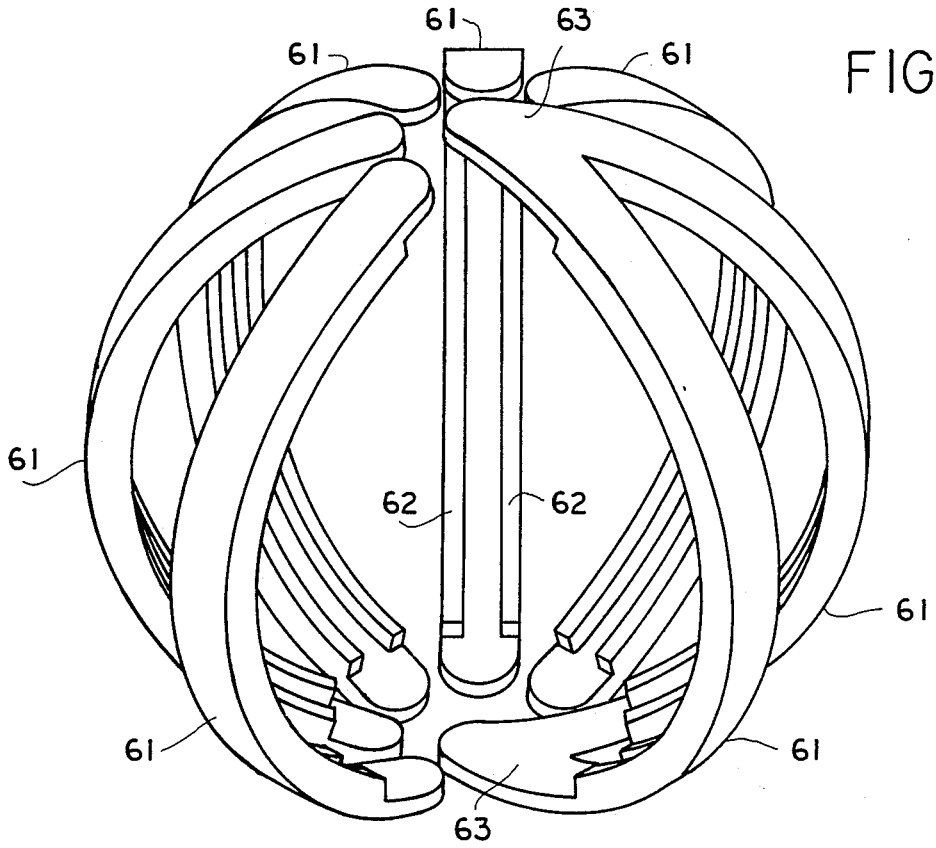
FIG. 4 is a perspective view of a configuration of the elongated arcuate joining elements which are the preferred embodiment for providing means for rotatably attaching the longitudinal segments to one another to form a sphere.

FIG. 4 shows the construction and orientation of elongated arcuate joining elements 61. Each joining element 61 has on both sides a flange 62. The flanges 62 slidably engage the elongated arcuate channels (not shown in this view) of the longitudinal segments (not shown in this view). Two adjacent elongated arcuate joining elements 61 are connected to one another at their ends by extension 63. The extension 63 locates all of the elongated arcuate joining elements 61 in their longitudinal position. The extension 63 prevents any of the joining elements 61 from becoming located across a pole of the sphere, which would prevent further hemispherical rotations of the sphere.

Figure 5:
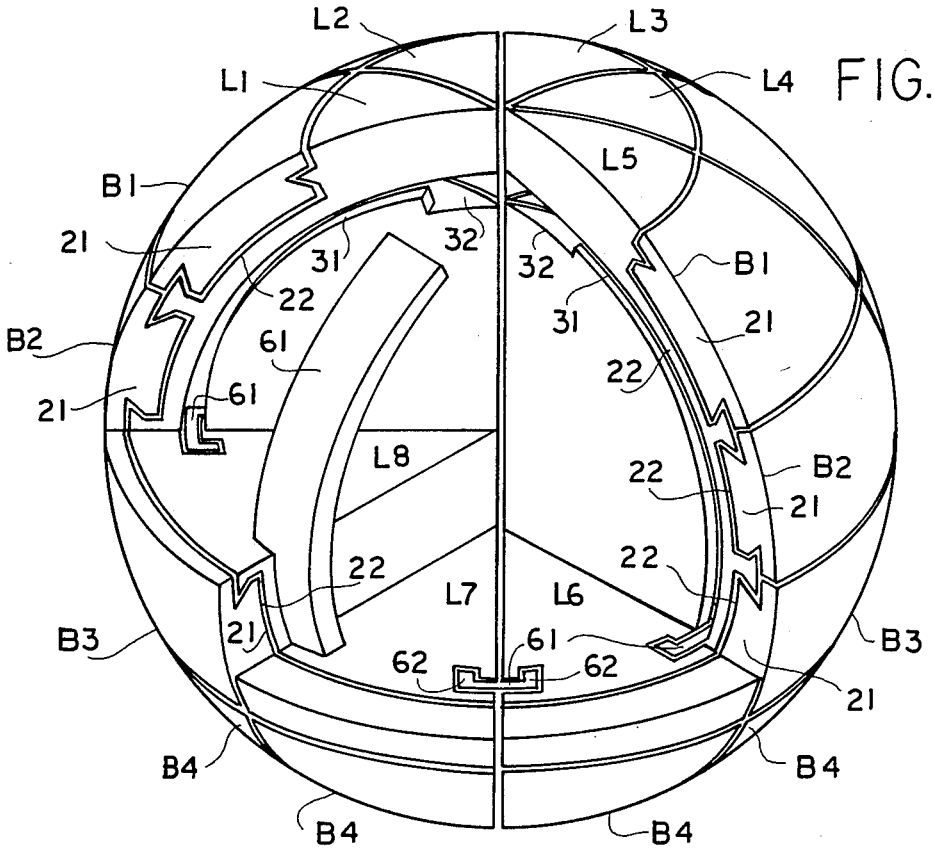
FIG. 5 is a perspective view, with cutaway sections, which illustrates the fully assembled device combining surface shell elements, longitudinal segments, and elongated joining elements.

FIG. 5 shows the assembly of the entire puzzle. Bands of surface shell elements B1 to B4 are latitudinally slidable about longitudinal segments L1 to L8. The longitudinal segments L1 to L8 are rotatably attached to one another by elongated arcuate joining elements 61, each joining element having a flange 62 that slidably interlocks with a channel 31 on each planar side of each segment element L1 to L8. Each channel 31 has a notch 32 at its ends to allow for the passing of flanges 62 of the joining elements 61 during rotation of hemispherical sets of longitudinal segments L1 to L8. The construction shown allows either planar surface of any longitudinal segment L1 to L8 to be oriented adjacent to either planar surface of any other longitudinal segment L1 to L8. Also any surface shell element in band B1 can be relocated to band B4, and the surface shell elements of bands B2 and B3 are also interchangeable.

FIG. 7A shows a design for the outer surfaces of the surface shell elements wherein land and sea boundaries represent the globe of the earth. These elements may also be rearranged as shown in FIG. 7B into one or more other logical solutions that have land and sea boundaries that meet at the adjacent edges of the surface shell elements B1 to B4.

Figure 7C:
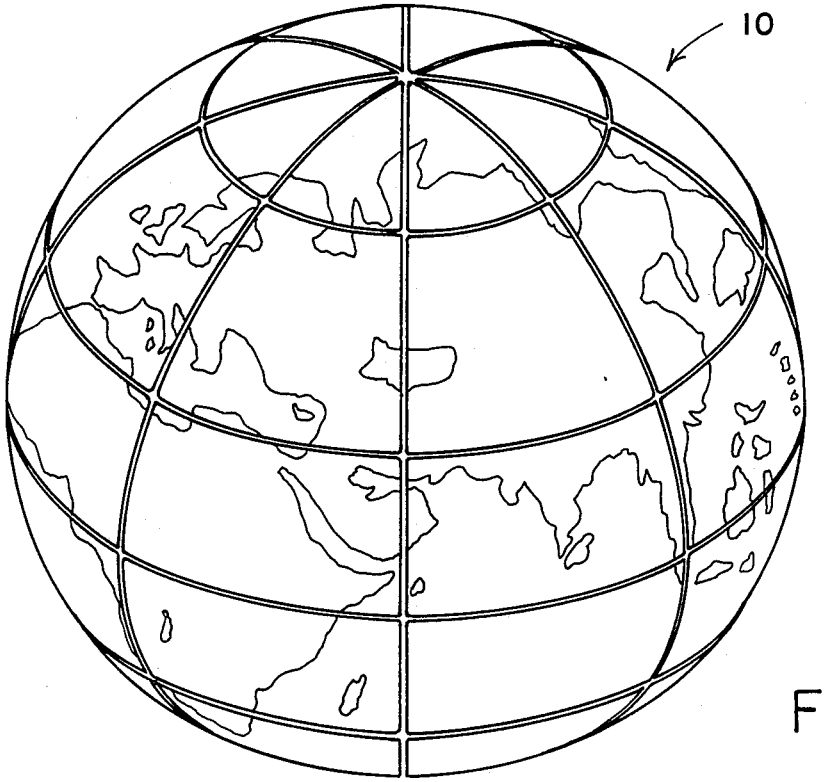
FIG. 7C shows a perspective view of the invention showing a map imprinted on the surface of the puzzle.

FIG. 7C shows the appearance of the puzzle as configured in FIG. 1A with a map imprinted on the surface shell elements.

The foregoing is considered as illustrative only of the principles of the invention. Further, since numerous modifications and changes will readily occur to those skilled in the art, it is not desired to limit the invention to the exact construction shown and described, and accordingly, all suitable modifications, and equivalents which may be resorted to fall within the scope of the invention.

What is claimed is:

1. A three dimensional sliding element puzzle comprising;

a plurality of longitudinal segments, each of said longitudinal segments defined by an outer compound curved surface and two intersecting planar surfaces;

first means for rotatably attaching said segments together to form a sphere, said sphere having an upper and lower pole, and a plurality of longitudinal planes passing through said poles, including means to permit relative hemispherical rotation between any two hemispherical sets of said segments separated by any of said longitudinal planes, said first means for rotatably attaching said segments further including;

an elongated arcuate channel disposed along each of said planar surfaces of said longitudinal segments; and a plurality of elongated arcuate joining elements, each of said joining elements having a pair of elongated arcuate flanges, whereby each of said elongated arcuate flanges slidably engages one of said elongated arcuate channels;

a plurality of primary surface shell elements disposed peripherally about said sphere, said primary surface shell elements arranged in latitudinal bands around said sphere formed by said longitudinal segments; and second means for slidably attaching said primary surface shell elements to said longitudinal segments, including means to permit relative latitudinal movements of any of said latitudinal bands of said primary surface shell elements relative to said longitudinal segments.

2. The three dimensional sliding element puzzle of claim 1, wherein said longitudinal segments have an internal compound curved surface, thereby defining a hollow interior of said sphere.

3. The three dimensional sliding element puzzle of claim 1 wherein, two of said elongate arcuate segment joining elements are connected at their ends, so that said joining elements are restricted from blocking said upper and lower poles of said sphere, whereby said elongated arcuate segment joining elements are maintained in a longitudinal position to permit relative hemispherical rotation between any two hemispherical sets of segments.

4. The three dimensional sliding element puzzle of claim 1 wherein, said primary surface shell elements are defined by an inner compound curved surface, an outer compound curved surface, top and bottom edges each parallel to a latitudinal plane, and two side edges each parallel to one of said longitudinal planes.

5. The three dimensional sliding element puzzle of claim 4 wherein, said outer compound curved surfaces of said primary surface shell elements have indicia thereon, whereby a solution of said puzzle is achieved by a specified arrangement of said primary surface shell elements.

6. The three dimensional sliding element puzzle of claim 4, wherein said second means for rotatably attaching said primary surface shell elements to said longitudinal segments comprises, first latitudinal channel disposed on each of said longitudinal segments;

a flange protruding from each said inner compound curved surface of each said primary surface shell element, said flanges slidably engaging said first latitudinal channels of said longitudinal segments.

7. The three dimensional sliding element puzzle of claim 5 wherein, said indicia represent land and sea boundaries and said indicia are disposed on said outer compound curved surfaces so that substantially continuous boundaries are exhibited in more than one arrangement of said primary surface shell elements.

8. A three dimensional sliding element puzzle comprising;

a plurality of longitudinal segments, each of said longitudinal segments defined by an outer compound curved surface and two intersecting planar surfaces;

first means for rotatably attaching said segments together to form a sphere, said sphere having an upper and lower pole, and a plurality of longitudinal planes passing through said poles, including means to permit relative hemispherical rotation between any two hemispherical sets of said segments separated by any of said longitudinal planes, a plurality of primary surface shell elements disposed peripherally about said sphere, said primary surface shell elements arranged in latitudinal bands around said sphere formed by said longitudinal segments; and second means for slidably attaching said primary surface shell elements to said longitudinal segments, including means to permit relative latitudinal movements of any of said latitudinal bands of said primary surface shell elements relative to said longitudinal segments;

said primary surface shell elements being defined by an inner compound curved surface, an outer compound curved surface, top and bottom edges each parallel to a latitudinal plane, and two side edges each parallel to one of said longitudinal planes;

wherein said second means for rotatably attaching said primary surface shell elements to said longitudinal segments further includes first latitudinal channels disposed on each of said longitudinal segments, and a flange protruding from each said inner compound curved surface of each said primary surface shell element, said flanges slidably engaging said first latitudinal channels of said longitudinal segments;

a second latitudinal channel disposed on said outer compound curved surfaces of one said latitudinal band of said primary surface shell elements;

a plurality of secondary surface shell elements, arranged in latitudinal bands peripherally about one said band of said primary surface shell elements;

third means for slidably attaching said secondary surface shell elements to said primary surface shell elements, including means to permit relative latitudinal movement of any of said latitudinal bands of secondary surface shell elements relative to said primary surface shell elements.

9. The three dimensional sliding element puzzle of claim 8, wherein said secondary surface shell elements are defined by an inner compound curved surface, and outer compound curved surface, top and bottom edges each parallel to a latitudinal plane, and two side edges each parallel to one of said longitudinal planes.

10. The three dimensional sliding element puzzle of claim 9, wherein said third means for slidably attaching said secondary surface shell elements to said primary surface shell elements comprises, a second latitudinal channel disposed on said outer compound curved surfaces of one of said bands of said primary surface shell elements;

a flange protruding from each said inner compound curved surface of each of said secondary surface shell elements, said flanges slidably engaging said second latitudinal channels of said primary surface shell elements.

* * * * *